US008365871B2

(12) United States Patent
Lee et al.

(10) Patent No.: US 8,365,871 B2
(45) Date of Patent: Feb. 5, 2013

(54) ELECTRONIC DEVICE AND METHOD FOR MONITORING AN ELEVATOR

(75) Inventors: Hou-Hsien Lee, Taipei Hsien (TW); Chang-Jung Lee, Taipei Hsien (TW); Chih-Ping Lo, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 274 days.

(21) Appl. No.: 12/888,401

(22) Filed: Sep. 22, 2010

(65) Prior Publication Data

US 2011/0253486 A1 Oct. 20, 2011

(30) Foreign Application Priority Data

Apr. 14, 2010 (TW) ..... 99111541 A

(51) Int. Cl.
*B66B 1/34* (2006.01)

(52) U.S. Cl. ..... 187/392; 187/247

(58) Field of Classification Search ..... 187/300, 187/306, 313, 314, 316, 317, 380–389, 391–396, 187/413, 247; 340/539.1, 539.16, 539.17
See application file for complete search history.

(56) References Cited

U.S. PATENT DOCUMENTS

| | | | | |
|---|---|---|---|---|
| 3,973,648 | A * | 8/1976 | Hummert et al. | 187/393 |
| 5,557,546 | A * | 9/1996 | Fukai et al. | 702/185 |
| 6,364,066 | B1 * | 4/2002 | Bolch et al. | 187/391 |
| 6,847,292 | B2 * | 1/2005 | Nlabu | 340/539.1 |
| 7,073,633 | B2 * | 7/2006 | Weinberger et al. | 187/393 |
| 7,284,639 | B2 * | 10/2007 | Sasaki et al. | 187/395 |
| 7,448,473 | B2 * | 11/2008 | Lindberg et al. | 187/392 |
| 7,823,703 | B2 * | 11/2010 | Amano | 187/392 |
| 7,837,013 | B2 * | 11/2010 | Amano | 187/392 |
| 8,069,958 | B2 * | 12/2011 | Lence-Barreiro | 187/393 |
| 2011/0067958 | A1 * | 3/2011 | Schuster et al. | 187/393 |
| 2012/0181117 | A1 * | 7/2012 | Chasteen | 187/392 |

* cited by examiner

*Primary Examiner* — Anthony Salata
(74) *Attorney, Agent, or Firm* — Altis Law Group, Inc.

(57) ABSTRACT

A method for monitoring an elevator controls an image capturing device located inside the elevator to capture a current image inside the elevator when a malfunction of the elevator is detected by one or more monitor devices. The method further analyzes the current image to determines if there are passengers trapped inside the elevator. In addition, the method generates a rescue message and sends the rescue message to an emergency response department through a network upon the condition that there are passengers trapped inside the elevator.

18 Claims, 4 Drawing Sheets

ELECTRONIC DEVICE AND METHOD FOR MONITORING AN ELEVATOR

BACKGROUND

1. Technical Field

Embodiments of the present disclosure relate generally to elevators, and more particularly to an electronic device and method for monitoring an elevator.

2. Description of Related Art

When an elevator is out of order due to power failure, fire, earthquake, or any other malfunction, any passengers trapped inside the elevator may try to use their mobile phones to contact help. However, it is typical that mobile phones do not work well, if at all, in elevators.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
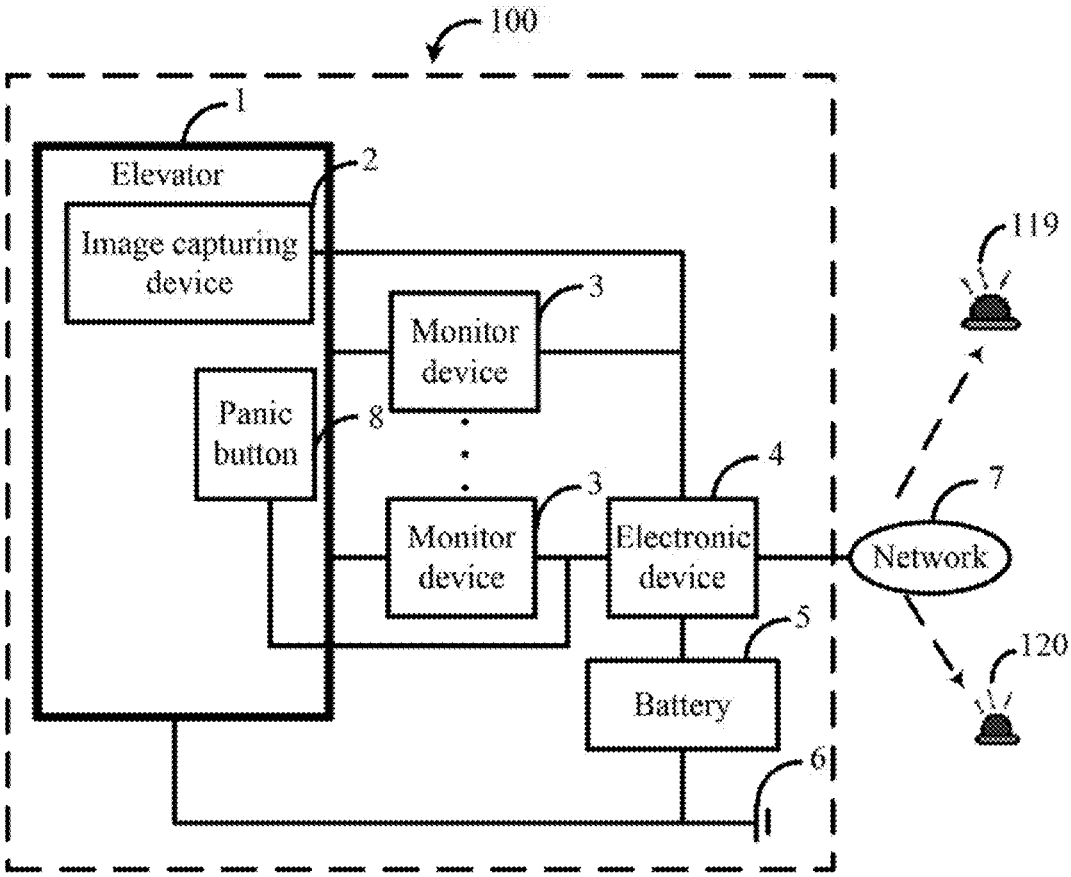
FIG. 1 is a schematic diagram of one embodiment of an elevator monitoring system.

FIG. 1 is a schematic diagram of one embodiment of an elevator monitoring system 100. In the embodiment, the elevator monitoring system 100 includes an image capturing device 2 located inside an elevator 1, a plurality of monitor devices 3, an electronic device 4, an battery 5, and a power supply 6. Each of the monitor devices 3 is electronically connected to the electronic device 4 and the elevator 1. If a malfunction of the elevator 1 is detected by one of the monitor devices 3, the monitor device 3 triggers the electronic device 4. In one embodiment, the monitor devices 3 may include an earthquake sensor, a pulley fault detector, a cable fault detector, and a power failure sensor, for example.

The image capturing device 2 is operable to capture a current image inside the elevator 1 when the electronic device 4 is triggered by one of the monitor devices 3. In one embodiment, the image capturing device 21 may be a digital camera, or a video camera capable of capturing digital images in the day or night.

In some embodiments, the electronic device 4 is further electronically connected to a panic button 8 located in the elevator 1. The electronic device 4 may be triggered when the panic button 8 is pressed by a passenger, and controls the image capturing device 2 to capture a current image inside the elevator 1.

When the electronic device 4 is triggered, the electronic device 4 controls the image capturing device 2 to capture a current image inside the elevator 1, and analyzes the captured image to determine if there are passengers trapped inside the elevator 1. Upon the condition that there are passengers trapped inside the elevator 1, the electronic device 4 generates a rescue message, and sends the rescue message and the current image to an emergency response department through a network 7. In one embodiment, the emergency response department may be a 911 emergency call center 119 and/or a building management office 120 of FIG. 1. The network 7 may be a wireless network or an internet.

Figure 2:
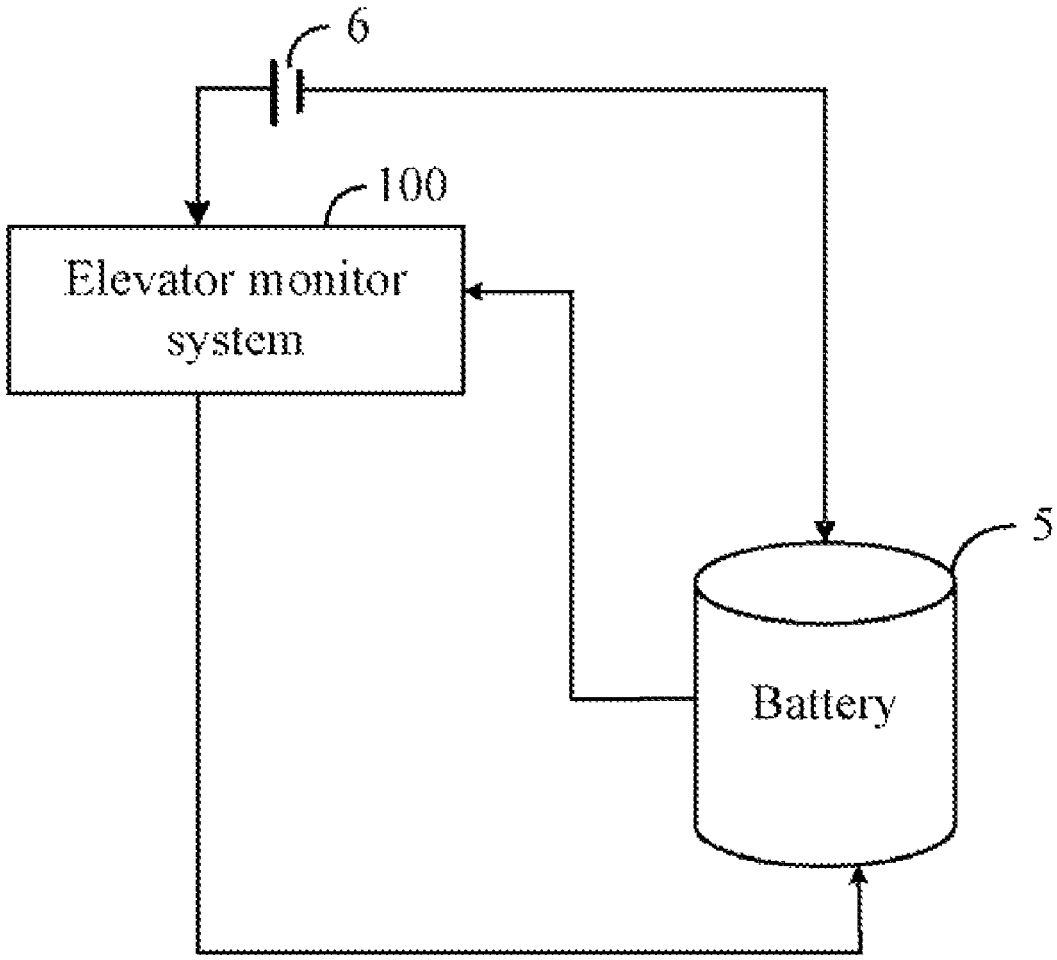
FIG. 2 shows a schematic diagram illustrating one example of power supply of the elevator monitor system of FIG. 1.

FIG. 2 shows a schematic diagram illustrating one example of a power supply of the elevator monitor system 100 of FIG. 1. In the embodiment, the power supply 6 provides power to the elevator monitor system 100, and charges the battery 5. If the power supply 6 fails, the battery 5 temporarily provides power to the elevator monitor system 100.

Figure 3:
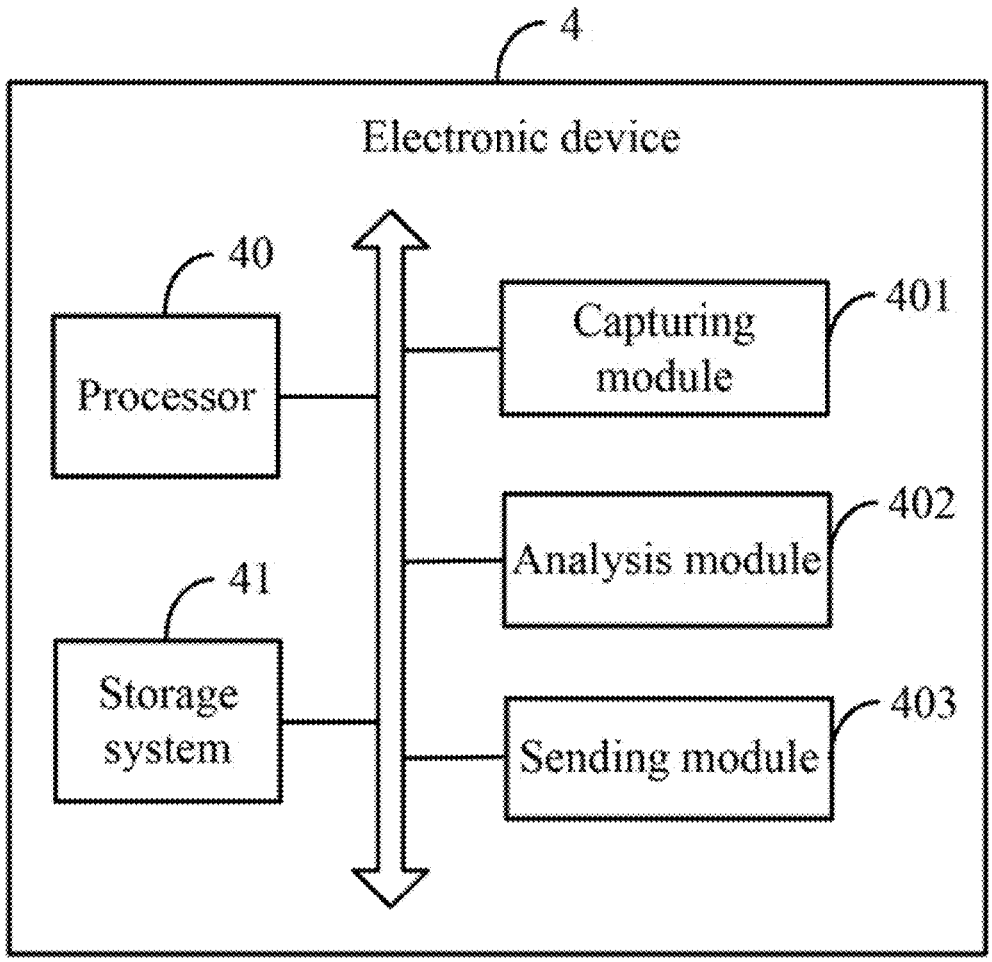
FIG. 3 is a schematic diagram of one embodiment of an electronic device included in the elevator monitoring system of FIG. 1.

FIG. 3 is a schematic diagram of one embodiment of the electronic device 4 of the elevator monitoring system 100 of FIG. 1. In the embodiment, the electronic device 4 includes a processor 40, a storage system 41, a capturing module 401, an analysis module 402, and a sending module 403. It should be apparent that FIG. 3 is only one example of the electronic device 4 and there can be more or fewer components, than shown here, in other embodiments, or a different configuration of the various components. The modules 401-403 may comprise computerized code in the form of one or more programs that are stored in the storage system 41. The computerized code includes instructions that are executed by the processor 40 to provide functions for the modules 401-403. In general, the word "module," as used herein, refers to logic embodied in hardware or firmware, or to a collection of software instructions, written in a programming language. The software instructions in the modules may be embedded in firmware, such as an erasable programmable read only memory (EPROM). The modules described herein may be implemented as either software and/or hardware modules and may be stored in any type of computer-readable medium or other storage device.

In one embodiment, The storage system 41 may be an internal storage device, such as a random access memory (RAM) for temporary storage of information, and/or a read only memory (ROM) for permanent storage of information. The storage system 41 may also be an external storage device, such as a hard disk, a storage card, or a data storage medium. The processor 40 runs various software modules stored in the storage system 41 to provide functions of the electronic device 4.

The capturing module 401 is operable to control the image capturing device 2 to capture a current image inside the elevator 1 when a malfunction of the elevator 1 is detected by the monitor devices 3. In one embodiment, one of the monitor devices 3 sends a triggering signal to trigger the electronic device 4 when a malfunction of the elevator 1 is detected. The capturing module 401 controls the image capturing device 2 to capture a current image when the electronic device 4 is triggered. In this or other embodiments, the electronic device 4 may be triggered when the panic button 8 is pressed.

The analysis module 402 analyzes the current image to determine if there are passengers trapped inside the elevator 1. In some embodiments, the analysis module 402 may use a human model detection method or a human face detection method to analyze the current image and detect passengers inside the elevator 1. For example, if the analysis module 402 extracts human models or human faces from the current image, the analysis module 402 determines that there are passengers trapped inside the elevator 1. Otherwise, if the analysis module 402 does not extract human model or human face from the current image, the analysis module 402 determines that there are no passengers trapped inside the elevator 1.

The sending module 403 generates a rescue message and sends the rescue message to the emergency response department through the network 7 upon the condition that there are passengers trapped inside the elevator 1. When the rescue message is sent to the emergency response department, the sending module 403 sends the current image to the emergency response department, so that the rescuers may know in detail the existing situation inside the elevator 1.

Figure 4:
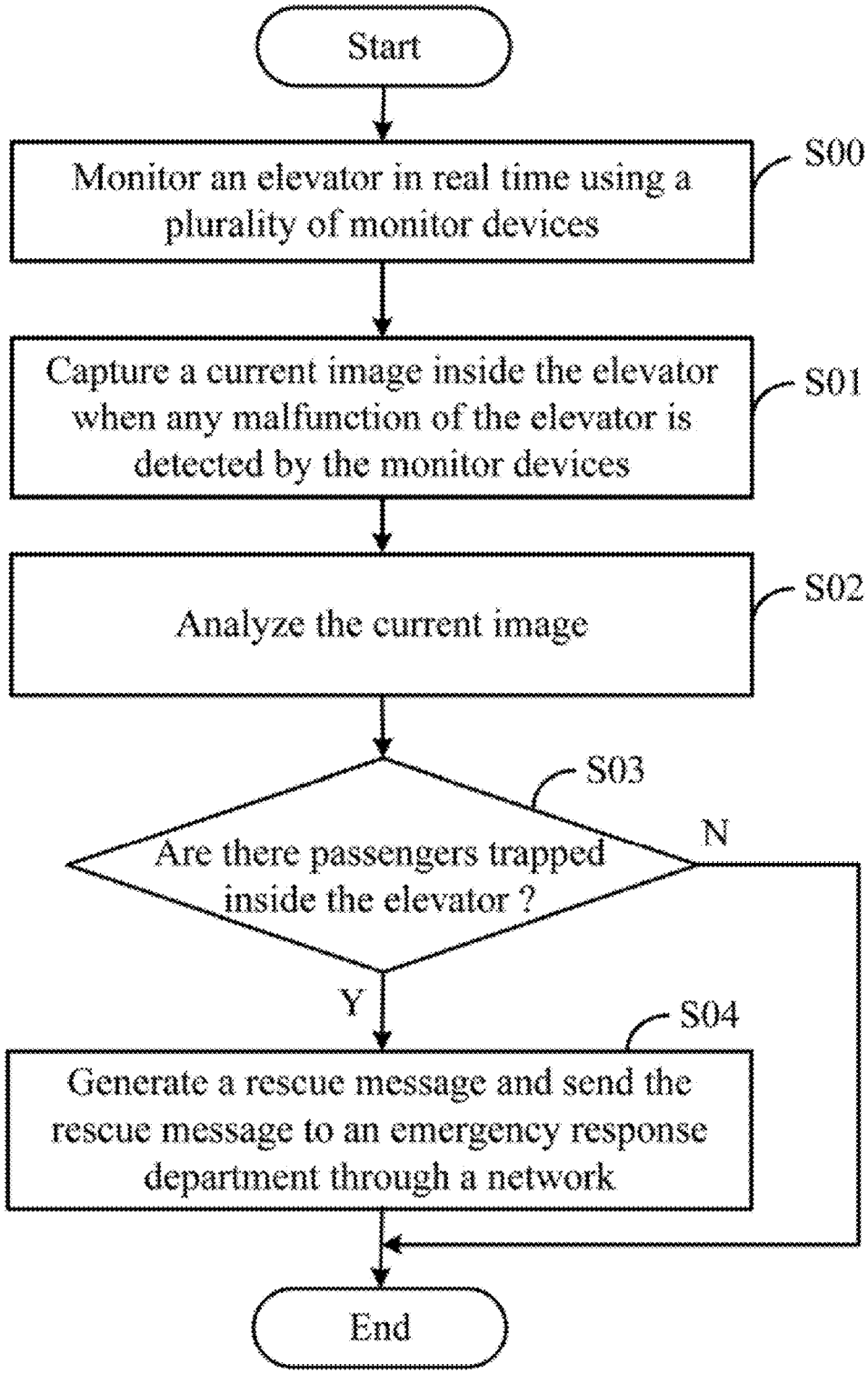
FIG. 4 is a flowchart of one embodiment of a method for monitoring the elevator using the system of FIG. 1.

FIG. 4 is a flowchart of one embodiment of a method for monitoring the elevator 1 using the system of FIG. 1. Depending on the embodiment, additional blocks may be added, others removed, and the ordering of the blocks may be changed.

In block S00, each of the monitor devices 3 monitors the elevator 1 in real time. As mentioned above, the monitor devices 3 may include an earthquake sensor, a pulley fault detector, a cable fault detector, and a power failure sensor, for example.

In block S01, the capturing module 402 controls the image capturing device 2 to capture a current image inside the elevator 1 when a malfunction of the elevator 1 is detected by the monitor devices 3. In one embodiment, the monitor device 3 sends a triggering signal to trigger the electronic device 4 when a malfunction of the elevator 1 is detected by the monitor devices 3. The capturing module 401 controls the image capturing device 2 to capture the current image when the electronic device 4 is triggered. In this or other embodiments, the electronic device 4 may be triggered when the panic button 8 is pressed.

In block S02, the analysis module 402 analyzes the current image to check for passengers trapped inside the elevator 1. In block S03, the analysis module 402 determines if there are passengers trapped inside the elevator 1 according to the analysis results. If there are passengers trapped inside the elevator 1, block S04 is implemented. Otherwise, if there are no passengers trapped inside the elevator 1, the procedure ends. As described above, the analysis module 402 may use a human model detection method or a human face detection method to analyze the current image and detect if passengers are trapped inside the elevator 1.

In block S04, the sending module 403 generates a rescue message and sends the rescue message to the emergency response department through the network 7 upon the condition that there are passengers trapped inside the elevator 1. When the rescue message is sent to the emergency response department, the sending module 403 further sends the current image to the emergency response department.

Although certain disclosed embodiments of the present disclosure have been specifically described, the present disclosure is not to be construed as being limited thereto. Various changes or modifications may be made to the present disclosure without departing from the scope and spirit of the present disclosure.

What is claimed is:

1. An electronic device for monitoring an elevator, the electronic device comprising:

a least one processor;

a storage system; and one or more programs stored in the storage system and executable by the at least one processor, the one or more programs comprising:

a capturing module operable to control an image capturing device located inside the elevator to capture a current image inside the elevator when the electronic device is triggered by one or more monitor devices electronically connected to the elevator, wherein each of the monitor devices is electronically connected to the electronic device, and sends a triggering signal to trigger the electronic device when a malfunction of the elevator is detected by any of the monitor devices;

an analysis module operable to analyze the current image to check for passengers inside the elevator by extracting human models or human faces from the current image, and determine if there are passengers trapped inside the elevator according to the analysis results; and a sending module operable to generate a rescue message and send the rescue message to an emergency response department upon the condition that there are passengers trapped inside the elevator.

2. The electronic device according to claim 1, wherein the sending module is further operable to send the current image to the emergency response department.

3. The electronic device according to claim 1, wherein the electronic device is electronically connected to a panic button located in the elevator.

4. The electronic device according to claim 3, wherein the electronic device is triggered when the panic button is pressed.

5. The electronic device according to claim 1, wherein the image capturing device is a digital camera or a video camera for capturing the digital images in the day or night.

6. The electronic device according to claim 1, wherein the monitor devices include an earthquake sensor, a pulley fault detector, a cable fault detector, and a power failure sensor.

7. A method for monitoring an elevator using an electronic device, the method comprising:

monitoring the elevator in real time using one or more monitor devices electronically connected to the elevator, wherein each of the monitor devices is electronically connected to the electronic device, and sends a triggering signal to trigger the electronic device when a malfunction of the elevator is detected by any of the monitor devices;

controlling an image capturing device located inside the elevator to capture a current image inside the elevator when the electronic device is triggered;

analyzing the current image to check for passengers inside the elevator by extracting human models or human faces from the current image;

determining if there are passengers trapped inside the elevator according to the analysis results; and generating a rescue message and sending the rescue message to an emergency response department upon the condition that there are passengers trapped inside the elevator.

8. The method according to claim 7, further comprising:

sending the current image to the emergency response department.

9. The method according to claim 7, wherein the electronic device is electronically connected to a panic button located in the elevator.

10. The method according to claim 9, wherein the electronic device is triggered when the panic button is pressed.

11. The method according to claim 7, wherein the image capturing device is a digital camera or a video camera for capturing the digital images in the day or night.

12. The method according to claim 7, wherein the monitor devices include an earthquake sensor, a pulley fault detector, a cable fault detector, and a power failure sensor.

13. A non-transitory storage medium having stored thereon instructions that, when executed by a least one processor of an electronic device, causes the electronic device to perform a method for monitoring an elevator, the method comprising:

monitoring the elevator in real time using one or more monitor devices electronically connected to the elevator, wherein each of the monitor devices is electronically connected to the electronic device, and sends a triggering signal to trigger the electronic device when the malfunction of the elevator is detected by any of the monitor devices;

controlling an image capturing device located inside the elevator to capture a current image inside the elevator when the electronic device is triggered;

analyzing the current image to check for passengers inside the elevator by extracting human models or human faces from the current image;

determining if there are passengers trapped inside the elevator according to the analysis results; and generating a rescue message and sending the rescue message to an emergency response department upon the condition that there are passengers trapped inside the elevator.

14. The storage medium as claimed in claim 13, wherein the method further comprises:

sending the current image to the emergency response department.

15. The storage medium as claimed in claim 13, wherein the electronic device is electronically connected to a panic button located in the elevator.

16. The storage medium as claimed in claim 15, wherein the electronic device is triggered when the panic button is pressed.

17. The storage medium as claimed in claim 13, wherein the image capturing device is a digital camera or a video camera for capturing the digital images in the day or night.

18. The storage medium as claimed in claim 13, wherein the monitor devices include an earthquake sensor, a pulley fault detector, a cable fault detector, and a power failure sensor.

* * * * *